US005271538A

United States Patent [19]

Lipker et al.

[11] Patent Number: 5,271,538

[45] Date of Patent: Dec. 21, 1993

[54] POUR-IT-ALL CANISTER

[76] Inventors: Brian Lipker, 311 Manatee Ave. W., Bradenton, Fla. 34205; Todd A. Huffman, 3520 Darion La., Plano, Tex. 75093

[21] Appl. No.: 918,697

[22] Filed: Jul. 27, 1992

[51] Int. Cl.[5] ..... B67D 3/00

[52] U.S. Cl. ..... 222/536; 222/526

[58] Field of Search ..... 272/526, 533, 536, 534, 272/535

[56] References Cited

U.S. PATENT DOCUMENTS

| | | | |
|---|---|---|---|
| 555,318 | 2/1896 | Hitt | 222/536 |
| 610,737 | 9/1898 | Dreyer | 222/536 |
| 942,847 | 12/1909 | Truesdale | 222/536 |
| 1,174,312 | 3/1916 | Gerhardt | 222/533 |
| 3,237,866 | 3/1966 | Lovell | 222/526 |
| 4,241,855 | 12/1980 | Yoshioka | 222/536 |
| 4,641,383 | 2/1987 | Sargent et al. | 222/533 |
| 4,811,870 | 3/1989 | Bianco | 222/533 |
| 4,949,857 | 8/1990 | Russell | 222/541 |

FOREIGN PATENT DOCUMENTS

| | | | |
|---|---|---|---|
| 1263585 | 3/1968 | Fed. Rep. of Germany | 222/533 |
| 226561 | 9/1989 | Japan | 222/526 |

*Primary Examiner*—Michael S. Huppert
*Assistant Examiner*—Thomas J. Barhan
*Attorney, Agent, or Firm*—Rodger H. Flagg

[57] ABSTRACT

An improved dispensing apparatus having a container sized to receive a pre-determined quantity of pourable material, and a pouring spout rotatably secured to the side of the container by an O-ring closely received in first and second complimentary grooves disposed between the pouring spout and the container side. The pouring spout preferably is of tubular configuration, with the elongated dispensing portion of a cross-sectional area of a larger size than the aperture in the side of the container. The elongated dispensing portion of the elongated pouring spout is preferably substantially the height of the container side, and is of non-circular cross section. A cap is threadably secured to the dispensing end of the pouring spout, and a seal may be adhesively secured to the dispensing end of the spout. The pouring spout may be sized to serve as an expansion chamber for the fluid in the container.

19 Claims, 2 Drawing Sheets

POUR-IT-ALL CANISTER

BACKGROUND OF THE INVENTION

Containers having a pour spout are well known in the art. Containers sized to hold a pre-determined quantity of liquid or particulate material, are also well known in the art.

U.S. Pat. No. 3,148,806 issued to P. Meshberg on Sep. 15, 1964 and U.S. Pat. No. 3,221,950 issued to W. R. O'Donnell on Dec. 7, 1965 are representative of prior art dispensers having a right angle spout which rotates from a stored position to a dispensing position.

U.S. Pat. No. 4,865,230 discloses a fluid dispenser having a right angle spout which is secured at the base in stored position, and is adapted to rotate for dispensing fluid.

U.S. Pat. No. 4,811,870 issued on Mar. 14, 1989 discloses a liquid container with rotatable spout, having a releasable cap threadably sealed at the neck and positioned at the top of the container.

U.S. Pat. No. 4,641,383 issued to C. Sargent et al on Feb. 10, 1987 discloses a holding tank having a right angle spout which rotates about the top of the tank, has a threaded cap, and an O-ring gasket seal.

SUMMARY OF THE INVENTION

The improved dispensing apparatus disclosed herein comprises a container of pre-determined size having a spout rotatably secured to the side wall of the container, near the top. The pivotal spout has a right angle bend to enable the spout to be closely aligned with the side wall of the container in the "stored" position, and the spout may be rotated to any 360 degree arcuate position for ease of aligning the spout with the access opening in which the pourable material is to be poured.

A cap is threadably secured to the distal end of the spout. The container may include an expansion area at the top of the container in proximity to the spout aperture. Preferably, the pouring spout is sized to serve as an expansion chamber, when needed.

A resilient O-ring serves to seal the rotatable spout about the aperture in the container, while allowing the spout to be positioned at any desired rotational position. Complimentary first and second grooves in the pouring spout and the flange surrounding the aperture in the housing serve to seal the spout in relation to the container. The resilient O-ring is initially compressed as the spout is forced onto the flange. Once aligned, the O-ring expands into the complimentary first and second grooves, securing and sealing the spout to the flange, while permitting 360 degree rotation therebetween. The pouring spout may be sized to serve as an expansion chamber for the pourable material in the container, thus reducing the overall size of the container.

The above mentioned and other features and objects of the invention, and the manner of attaining them will be best understood by reference to the following description of an embodiment of the invention, when considered in conjunction with the accompanying drawings.

DETAILED DESCRIPTION OF THE PREFERRED EMBODIMENTS

Figure 1:
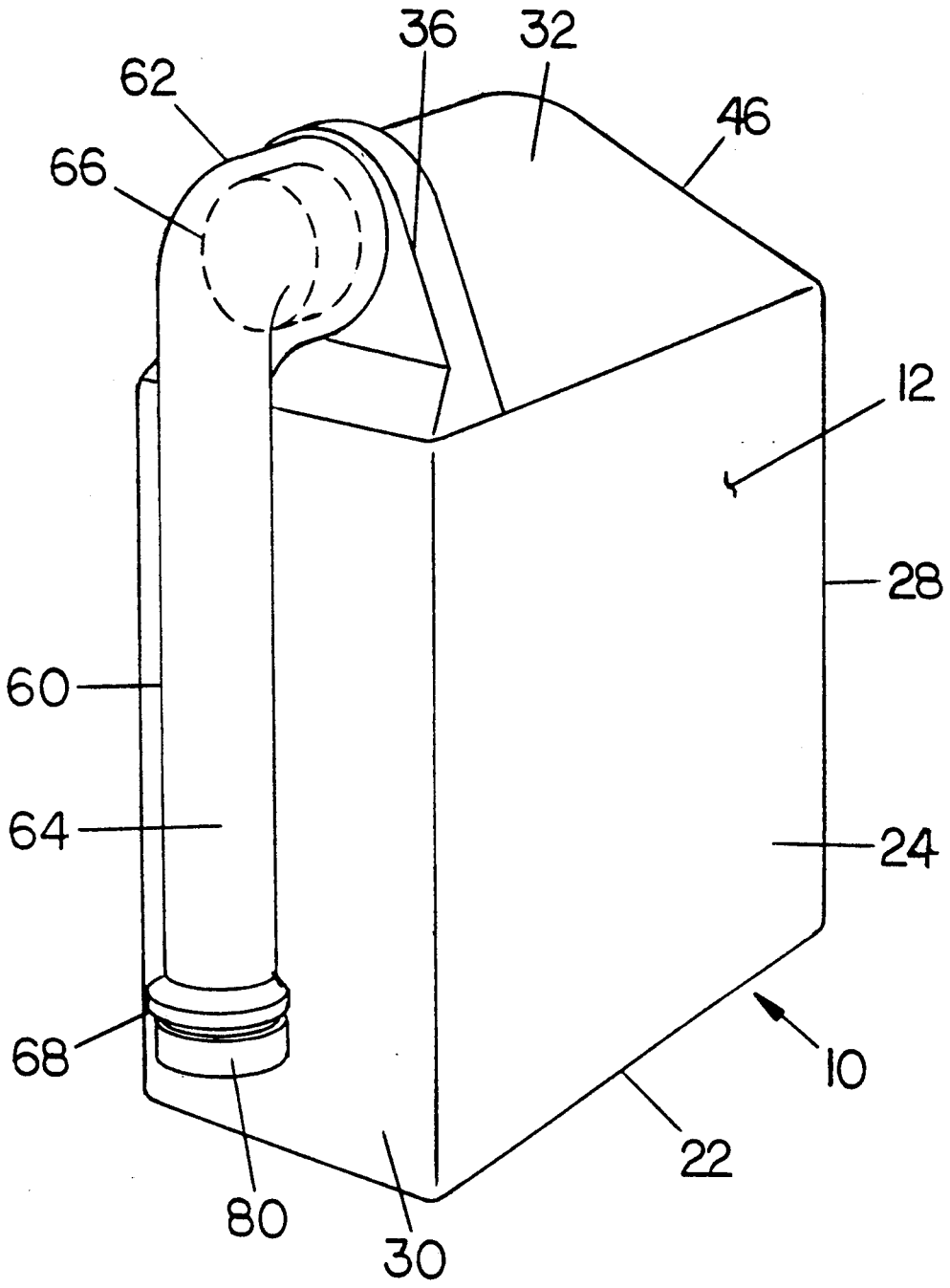
FIG. 1 is a perspective view of the improved container, showing the spout rotated into the "stored" position.

The subject matter which I regard as my invention is particularly pointed out and distinctly claimed in the claims. The structure and operation of my invention, together with further objects and advantages, may be better understood from the following description given in connection with the accompanying drawings, in which:

FIG. 1 shows a perspective view of the container apparatus 10, having a chamber 34 of predetermined size, for storing, transporting and dispensing a pourable material 12, which may be a pourable liquid or particulate solid. The pourable material 12 may be a viscous liquid, such as automotive oil, salad dressing, ketchup, etc. or other pourable liquid, such as household cleaning fluid, brake fluid, windshield wiper fluid, household or industrial chemicals, liquid fertilizers, gasoline, etc.

Alternately, the fluid material may be a particulate solid material, such as popcorn kernels, plant seeds, dog food particles, ice melting salts, dry chemicals, dry fertilizers, etc. The fluid material 12 may comprise any known liquid or particulate material which is suitable for storage, transport and dispensing from a container, and all such known fluids are intended to fall within the scope of this disclosure and claims.

The container 20 has a bottom 22, front side 24, back side 26, left side 28, right side 30 and a top portion 32, which form an enclosed chamber 34 suitable for storing the selected quantity of fluid material 12 therein. The corners thus formed may be rounded to suit manufacturing or design preference.

The container 20 is sized to receive a pre-determined quantity of pourable material 12, such as a quart, gallon, pound, or other known unit of liquid or dry measure. The chamber 34 formed by the front side 24, back side 26, left side 28, right side 30 and top portion 32 may include room for expansion 36 of the pourable material 12 contained within container 20.

When needed, the expansion area 36 should be sized to provide sufficient expansion for the pourable material 12 contained within, due to anticipated temperature changes, or other known factors affecting the expansion of the pourable materials 12 contained within the container 20.

A horizontal lip or groove 38 may extend along opposing sides 28, 30 or front and back portions 24, 26 of the container 20 near the top portion 32 for ease of handling the container during use.

Figure 2:
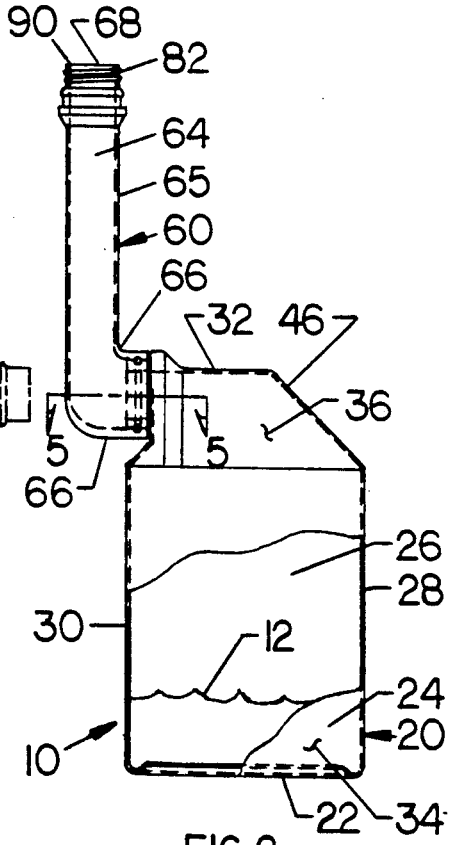
FIG. 2 is a front view of the improved container, with the spout rotated 180 degrees, and the cap removed, in preparation for pouring the pourable material from the container.

The upper portion of the front 24, back 26 and side 28 may be tapered to suit manufacturing or design preference, as shown in FIG. 2. The container 20 is preferably made of plastic of thin cross-sectional material having a thickness less than 0.093 inches. Other known materials suitable for storing, transporting and dispensing the selected pourable material 12 may also be used. The container 20 may be fabricated by any known means, such as by injection molding, blow molding, vacuum forming, etc. The container 20 may be made in one or more pieces, and sealed together with suitable means known to the art, to form or fabricate the chamber 34 disclosed herein. The container material may be biodegradable, or may be designed to be re-usable to suit manufacturing and design preference.

A suitable aperture 40 is provided in one side 24, 26, 28 or 30 of the container 20, preferably near the top 32. A cylindrical flange 42 preferably surrounds the aperture 40, and extends horizontally beyond the outer profile of the container 20.

A first annular groove 44 is preferably disposed on the external side of the cylindrical flange 42, between the side of the container 20 and the distal end of the flange 42. The first annular groove 44 is sized to closely receive a portion of an O-ring 50 to form a seal therebetween.

A right angle pouring spout 60 of tubular configuration, has a horizontal cylindrical flange portion 62, joined to an elongated dispensing portion 64 by a right angle bend 66 which is sized to position the elongated dispensing portion 64 in close proximity to one side 24, 26, 28 or 30 of the container 20 having the aperture 40, when the pouring spout 60 is rotatably positioned in the "stored" position as shown in FIG. 1.

Figure 5:
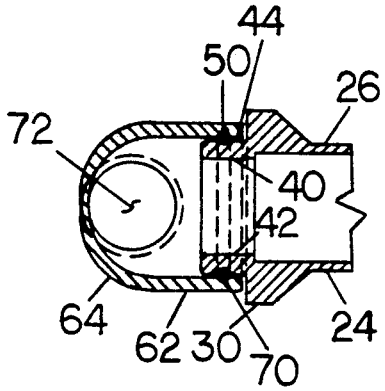
FIG. 5 is a cross sectional view of the O-ring seal taken along lines 5—5 in FIG. 2.
Figure 4:
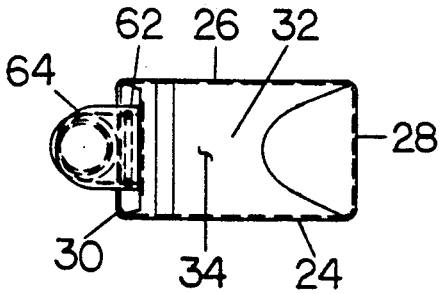
FIG. 4 is a top view of the container.

As best seen in FIG. 5, a second, complimentary annular groove 70 is preferably disposed on the internal side of the cylindrical flange portion 62, between the right angle bend 66 and the distal end 68 of the flange portion 62. The second annular groove 70 is sized and positioned to closely receive a portion of the O-ring 50 at assembly, to form a rotatable seal therebetween.

The pouring spout 60 may be sized to serve as the area for expansion 36 for the pourable material 12 stored within the container 20, thereby reducing the overall size of the container.

It is within the scope of this disclosure, to alternately position the flange portion 62 of the pouring spout 60 within the cylindrical flange 42 extending from container 20. In this case, the first annular groove 44 is positioned within the cylindrical flange 42 extending from the container 20, and the second, complimentary annular groove 70 would be positioned on the external side of the flange portion of the pouring spout 60. Such adaptations and modifications are intended to fall within the scope of this disclosure and the accompanying claims.

The elongated dispensing portion 64 of pouring spout 60 is preferably of non-circular cross-section, to conform to the streamlined shape of the container 20, and is of a cross-sectional area greater than the cross-sectional area of the aperture 40 to reduce the pulsating effect of the pourable material 12 passing through the pouring spout 60, as air is drawn into the chamber 34 through the dispensing end 72 of the pouring spout 60. See FIG. 5.

Figure 3:
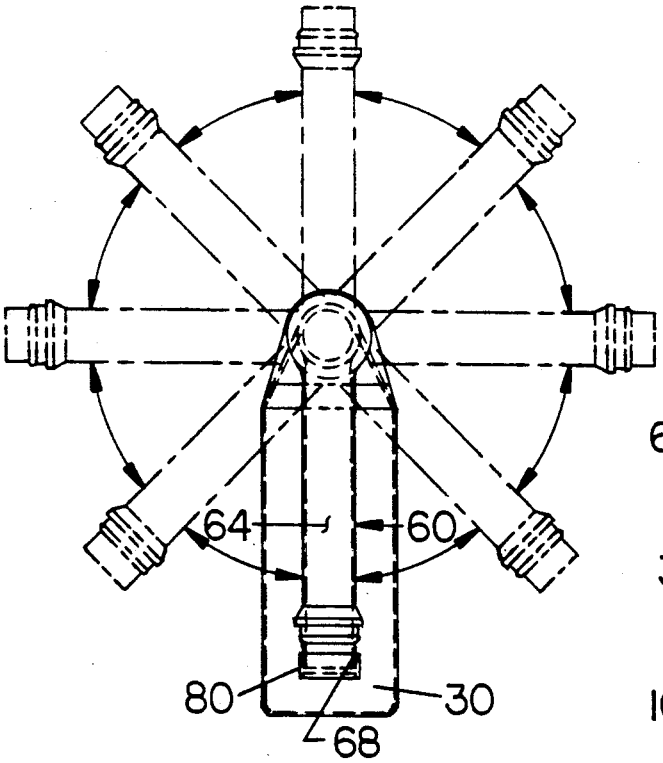
FIG. 3 is an end view of the container showing in dashed lines several possible rotational positions of the pour spout in relation to the container.

The O-ring seal enables the user to move the pouring spout 60 in either a clockwise or counter-clockwise direction to quickly position the pouring spout 60 in any 360 degree rotatable position as shown by arrows 76, for ease of both right handed and left handed users. See FIG. 3.

The dispensing end 72 of the of pouring spout 60 is preferably threaded 74 to releasably secure a cap 80 having complementary threads 82. The threaded portion 74 of spout 60 may have male or female threads, to suit manufacturing preference. The cap 60 serves to retain a portion of the pourable material 12, when desired, after partially dispensing the pourable material 12 from the container 20. Cap 60 eliminates the problem of spilling during transport, and reduces the effects of evaporation, etc. during storage.

A suitable seal 90, may be secured over the dispensing end 72 of pouring spout 60, to further improve the shelf life of the unopened container apparatus 10. A foil seal 90 adhesively secured to the dispensing end of the pouring spout 60 is preferred.

Cap 80 may be threadably secured over seal 90, to protect the seal 90 prior to use, during transport or storage. See FIG. 2.

A plurality of improved dispensing apparatus 10 may be compactly boxed together with the spout 60 in "stored" position, for ease of shipping, or stored side-by-side on shelves, without wasting valuable shelf space. The rotatable spout 60 may be easily positioned in any 360 degrees rotatable configuration for ease of dispensing, particularly when access space is limited.

In use, the container 10 may be removed from a box or shelf, and the spout 60 rotated for ease of unthreading the cap 80 from the pouting spout 60. The O-ring 50 allows the spout 60 to be rotated 360 degrees in either a clockwise or counter-clockwise direction without leakage between the spout 60 and the container flange 42.

Once the cap has been removed, the seal 90 (when used) may also be removed from the distal end 68 of the pouring spout 60, and the container 20 positioned for ease of dispensing the pourable material 12 from the container 20.

Where access space is limited, such as when pouring oil into the engine of a vehicle, both the pouring spout 60 and the container 20 may be simultaneously manipulated and rotatably positioned to avoid spilling the fluid prematurely. Once the pouring spout 60 is safely positioned in the desired location, the container 20 may be raised while the spout remains in place, to safely empty the fluid 12 from the container 20, without spilling, and without dispensing the pourable material 12 faster than desired.

A transparent or translucent window may be provided on one of the sides 24, 26, 28 or 30 of container 20, or in the top portion 32 to enable the user to quickly determine the quantity of pourable material 12 remaining in the container 20. Where desired, the entire container 20 may be made of a transparent or translucent material.

Thus, while the novel container apparatus 10 has been fully disclosed and described herein, numerous modifications will become readily apparent to one of ordinary sill in this art, and such modifications are intended to be included within the scope of the following claims.

What is claimed is:

1. A dispensing apparatus, comprising:

a) a container having a bottom, opposite side in spaced relation, and a top forming an enclosed chamber therebetween sized to receive, store and dispense a pre-determined quantity of pourable material therein;

b) an aperture disposed through one side of the container near the top of the container, with a horizontal cylinder flange portion surrounding the aperture, and a first annual groove disposed about the cylindrical flange portion;

c) a tubular pouring spout having a cylindrical flange portion and an elongated dispensing portion, with a second, complimentary annular groove disposed about the cylindrical flange portion of the pouring spout, and a right angle portion extending between the cylindrical flange portion and an elongated dispensing portion;

d) a cap releasably secured to the dispensing end of the pouring spout; and e) an O-ring sized to be closely received within a portion of the complimentary first and second annular grooves to form a seal therebetween, while allowing the pouring spout to be rotatably positioned at any desired 360 degree location in relation to the container, wherein the pouring spout is sized to provide an area for thermal expansion of the pourable material stored within the container.

2. The apparatus of claim 1, wherein the container is reduced to size by providing an area in the pouring spout for thermal expansion of the pre-determined quantity of pourable material stored within the container.

3. The apparatus of claim 1, wherein the elongated dispensing portion of the pouring spout is of a non-circular configuration having a cross-sectional area greater than the cross-sectional area of the aperture in the side of the container.

4. The apparatus of claim 1, wherein the dispensing end of the pouring spout is threaded to releasably secure a threaded cap thereon.

5. The apparatus of claim 1, wherein an air-tight seal is adhesively secured to the dispensing end of the pouring spout.

6. The apparatus of claim 1, wherein the pouring spout has a flat portion positioned adjacent to the side of the container, and a curved portion extending from opposing sides of the flat portion to form a generally "D" shaped elongated dispensing portion therebetween.

7. The apparatus of claim 1, wherein the pourable material is motor oil, and the O-ring seal is made of a resilient material which will not degrade in the presence of oil.

8. The apparatus of claim 1, wherein the container and pouring spout is made from bio-degradable materials.

9. The apparatus of claim 1, wherein the elongated dispensing portion of the pouring spout extends substantially the height of the side of the container when rotated into a stored position.

10. The apparatus of claim 1, wherein the container is tapered near the top to conform to the general cylindrical flange portion of the pouring spout.

11. A dispensing apparatus for pourable material, comprising:

a) a container having a bottom, front, back, opposing sides and a top forming an enclosed chamber therebetween sized to receive a pre-determined quantity of pourable material therein;

b) an aperture disposed through one side of the container near the top of the container, with a horizontal flange portion surrounding the aperture, and a first annular groove disposed about the cylindrical flange portion;

c) a tubular pouring spout having a cylindrical flange portion and an elongated dispensing portion, with a second, complimentary annular groove disposed about the cylindrical flange portion of the pouring spout, and a right angle portion extending between the cylindrical flange portion and an elongated dispensing portion, the tubular pouring spout sized to provide an area for thermal expansion of the pourable material within the container, the elongated dispensing portion of the pouring spout being of a non-circular configuration having a cross-sectional area greater than the cross-sectional area of the aperture in the container;

d) a cap releasably secured to the dispensing end of the elongated dispensing portion of the pouring spout; and e) an O-ring sized to be closely received within a portion of the complimentary first and second annular grooves to form a seal therebetween, while allowing the pouring spout to be rotatably positioned at any desired 360 degree location in relation to the container.

12. The apparatus of claim 11, wherein the container is reduced in size by providing an area in the pouring spout for thermal expansion of the pre-determined quantity of pourable material stored within the container.

13. The apparatus of claim 11, wherein the dispensing end of the pouring spout is threaded to releasably secure a threaded cap thereon.

14. The apparatus of claim 11, wherein an air-tight seal is adhesively secured to the dispensing end of the pouring spout.

15. The apparatus of claim 11, wherein the pouring spout has a flat portion positioned adjacent to the side of the container, and a curved portion extending from the sides of the flat portion to form a generally "D" shaped elongated dispensing portion therebetween.

16. The apparatus of claim 11, wherein the dispensing material is motor oil, and the O-ring seal is made of a resilient material which will not degrade in the presence of oil.

17. The apparatus of claim 11, wherein the container and pouring spout are made from bio-degradable material.

18. A dispensing apparatus for pourable material comprising:

a) a container having a bottom, front, back, opposing sides and a top forming an enclosed chamber therebetween sized to receive a pre-determined quantity of pourable material therein;

b) an aperture disposed through one side of the container near the top of the container, with a horizontal cylindrical flange portion surrounding the aperture, and a first annular groove disposed about the cylindrical flange portion;

c) a tubular pouring spout having a cylindrical flange portion and an elongated dispensing portion, with a complimentary, second annular groove disposed about the cylindrical flange portion of the pouring spout, and a right angle portion extending between the cylindrical flange portion and an elongated dispensing portion, the elongated dispensing portion of the pouring spout being of a non-circular configuration having a cross-sectional area great than the cross-sectional area of the aperture in the container, with a flat portion positioned adjacent to the side of the container, and a curved portion extending from the opposing sides of the flat portion to form a generally "D" shaped elongated dispensing portion therebetween; and d) a cap releasably secured to the dispensing end of the tubular pouring spout, the tubular pouring spout sized to provide an area for thermal expansion of the pourable material within the container; and e) an O-ring sized to be closely received within a portion of the complimentary first and second annular grooves to form a seal therebetween, while allowing the pouring spout to be rotatably positioned at any 360 degree location in relation to the container.

19. The apparatus of claim 18 wherein the dispensing end of the pouring spout is threaded to releasably secure a threaded cap thereon.

* * * * *